United States Patent [19]

Mathou

[11] 4,346,885

[45] Aug. 31, 1982

[54] WATER-AND/OR SANDBOX CONSTRUCTION

[76] Inventor: Marcel Mathou, 12630 Gages, France

[21] Appl. No.: 200,056

[22] Filed: Oct. 23, 1980

[30] Foreign Application Priority Data

Nov. 7, 1979 [FR] France ..... 79 27501

[51] Int. Cl.[3] ..... A63G 31/00

[52] U.S. Cl. ..... 272/1 A; 4/488; 4/494; 272/56.5 R; 46/16

[58] Field of Search ..... 272/1 A, 1 B, 56.5 R, 272/56.5; 4/494, 506, 567, 488, 495, 571, 578, 579, 589; 46/16

[56] References Cited

U.S. PATENT DOCUMENTS

| | | | |
|---|---|---|---|
| 1,600,055 | 9/1926 | Meyer | 272/1 A |
| 2,580,942 | 1/1952 | Murad et al. | 272/1 A |
| 2,706,630 | 4/1955 | Cisne | 272/1 B |
| 3,171,651 | 3/1965 | Merdich et al. | 272/1 A X |
| 3,181,534 | 5/1965 | Davis | 4/578 X |
| 3,488,782 | 1/1970 | Billig et al. | 4/506 |
| 3,619,823 | 11/1971 | Sackett | 4/567 |
| 3,823,426 | 7/1974 | Mitchko | 4/494 |

OTHER PUBLICATIONS

"Parade", Jul. 9, 1972, p. 14.

*Primary Examiner*—George J. Marlo

*Attorney, Agent, or Firm*—Cushman, Darby & Cushman

[57] ABSTRACT

There is disclosed a water-and/or sandbox construction comprising an integrally moulded body having side walls and inclined upper edges, the bottom of which is formed with shaped protrusions or recesses for releasable engagement with complementarily shaped mounting portions of stackable levelling members having slots formed in their sides, which function as support members of selective height for supporting, depositing or storing members adjacent the top surface of the product contained within the box at a distance from the periphery of the box.

11 Claims, 4 Drawing Figures

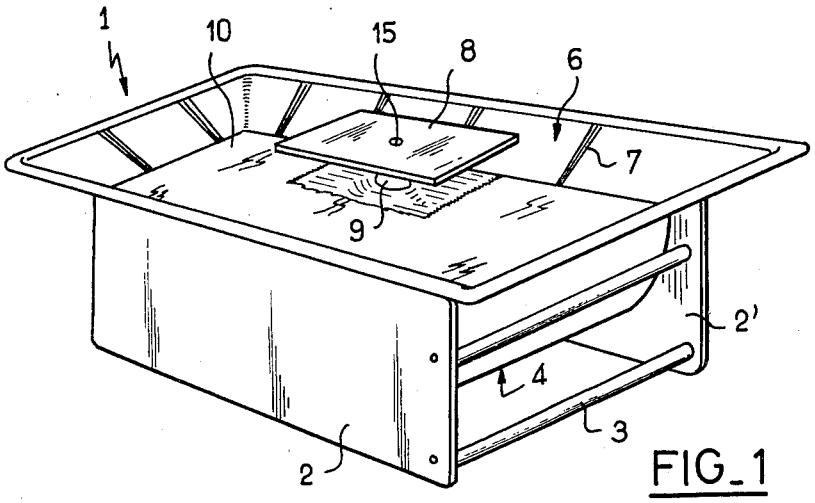
FIG_1
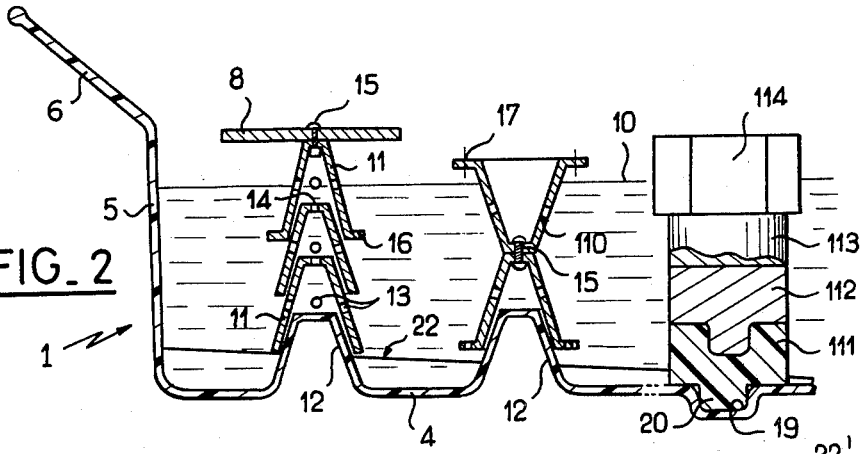
FIG_2
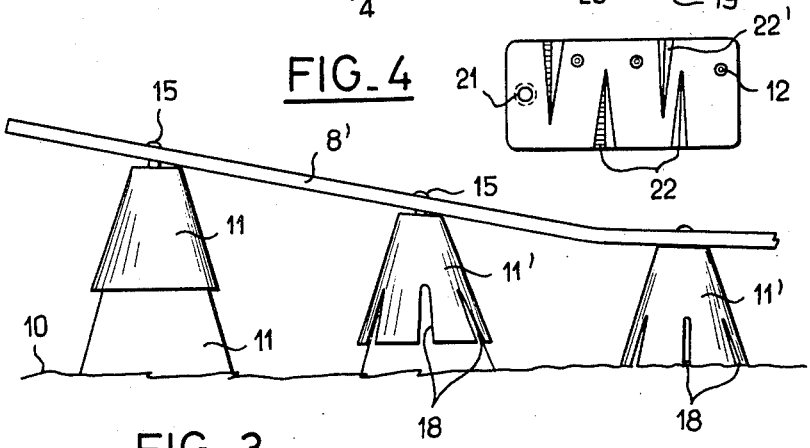
FIG_3
FIG_4

WATER-AND/OR SANDBOX CONSTRUCTION

BACKGROUND OF THE INVENTION

The invention relates to a construction of a water-and/or sandbox, more particularly for educative and entertaining activities of young children.

PRIOR ART

Water-and/or sandboxes are commonly used in the infant schools or day nurseries, which have the form of a box or tank body arranged substantially at the center of a table-forming cut-away platen supported by a convenient stand. Said boxes which are mainly utilized indoor, are arranged in such a manner that the peripheral flat edge portions of the cut-away platen provides between its peripheral edge and the inner portion of the box containing the liquid or the sand safety peripheral zones allowing the children to have access to the content of the box by reaching out their arms but preventing same from bending forward above the content of the box and accordingly inadvertently falling down in the box. Such constructions are fully satisfactory as concerns the utilization and safety aspects, but it has been found that said peripheral edge portions, which define the safety zone as also a surface available for depositing thereon different objects, such as toys, do not prevent sand or water which has been withdrawn from the box when handling said objects, from progressively overlying said edge portions and falling off the platen, with the inherent stain and cleaning drawbacks.

In order to obviate said drawbacks, it has been proposed a box construction with inwardly inclined peripheral edge portions, whereby permitting to recover liquid or sandy projections and deposits back into the box. However, by reason of the inclination of said edge portions, said latter are no more useful as surfaces available for depositing or storing thereon the different floating or burrowing objects utilized by the children in association with the box and it has been ascertained that when lodged or deposited on the ground or on appendent trays said objects led to dispersion of water or sand on the surrounding areas as with the boxes having a flat peripheral edge portion.

OBJECTS OF THE INVENTION

Accordingly, it is a main object of the invention to provide an improved water-and/or sandbox of the type having inwardly inclined edge portions and further comprising means for releasably supporting different accessible constructions in the vicinity of the surface of the product contained within the box, at a distance from the periphery of the box, whereby achieving a greater versatility in the utilization of the box without encumbering and complicating the edges of the box with side securing means to thereby provide, all over the periphery of the box, more particularly when said latter is filled with water, free available surfaces.

There is another object of the invention to provide an integrally moulded box of the character described having improved stiffness and mechanical strength.

In order to meet these and other objects, the water-and/or-sandbox of the invention, which comprises a bottom and integrally formed therewith side-walls prolongated upwardly by inwardly inclined edge portions, further comprises at least a separate support member adapted to be selectively and separably mounted on the bottom of the box for releasably supporting at least one construction accessible at the vicinity of the surface of the product contained within the box but at a distance of the side-walls of the box.

According to another feature of the invention, said support member consists in a stack of a plurality of conveniently shaped levelling members, the bottom of the box having locally shaped portions or mouldings adapted for engagement cooperation with complementary shaped portions or mouldings at one end of the support member.

BRIEF DESCRIPTION OF THE DRAWINGS

Other objects and advantages of the present invention will become apparent from reading of the following description taken with reference to the appended drawings wherein:

FIG. 1 is a schematic perspective view of the box construction according to the invention;

FIG. 2 is a schematic partial cross section of such box equipped with different support members according to the invention;

FIG. 3 is a side view at a greater scale of a mode of mounting a releasable construction in the box by means of the frustoconical levelling members illustrated in FIG. 2; and FIG. 4 is a top view of the bottom of the box body according to the invention.

DETAILED DESCRIPTION OF THE PRREFERRED EMBODIMENTS

As illustrated in FIG. 1, a water-and/or-sandbox of the invention comprises a box or a tank body 1, advantageously integrally moulded out of acrylonitrile-butadienestyrene, and supported by side panels 2,2' forming a stand for the box and braced by transverse tubes 3. As best seen in FIG. 2, the box body 1 comprises a bottom 4 and substantially vertical side-walls 5 flushingly prolongated upwardly by inwardly slanted edge portions 66 which are advantageously provided with spaced parallel stiffening ribs 7.

There is illustrated in FIG. 1 a plate or shelf 8 as an available surface for depositing thereon objects, which is supported by a support member 9 so as to extend in the vicinity of the top surface 10 of the product within the box, at a distance from the adjacent edge portion 6 of the box. Such a plate 8 is also illustrated on the left part of the cross-section in FIG. 2.

In said embodiment, the support member 9 for the plate 8 consists in a stack of cup-shaped or frustoconical levelling members 11 made out of plastic material and interleaved to form a column having a height depending from the dimensions and the number of the levelling members 11. According to the invention, the bottom 4 of the box body 1 is formed integrally at different locations with hollow frustoconical protrusions 12 extending inwardly in the inner space of the box, said protrusions being shaped and dimensioned to correspond to the levelling members 11. More particularly for the utilization of the box as a waterbox, the hollow frustoconical levelling members 11 are formed with openings 13 in the lateral wall thereof for permitting passage of the product contained within the box, and also with at least a transversing hole 14 in the bottom wall closing the small end of the frustoconical members 11 for allowing mounting on the uppermost levelling member of the plate 8 or any other convenient construction by means of a stud, plastic rivets or a screw-and-nut assembly 15.

At least some of said frustoconical levelling members 11 are advantageously formed at their end of greater diameter with a radially outwardly extending flange 16 formed with openings 17 for alternatively stackingly mounting said levelling members top to bottom, whereby, as illustrated in the middle of FIG. 2, an uppermost inverted frustoconical levelling member, designated by the reference numeral 110, may serve as an auxiliary container partially immersed within the product in the box, for instance for storing small floating objects.

As illustrated in FIG. 3, frustoconical levelling members 11' devoid of such a radial flange are advantageously formed with longitudinal slots 18 extending from the end of greater diameter partially over the height of the side-wall so as to achieve, by resilient deformation, a more pronounced flaring of said end of greater diameter to adjust driving-in of the mutually imbricated levelling members and make it more difficult to disassemble same by the children, and to further permit, as illustrated in FIG. 3, to realize with a same number of stacked levelling members different levels immersed or emerged, for instance for mounting bent or inclined plates 8' to realize a toboggan, said plates 8' being advantageously made out of semi-rigid plastic material.

There is illustrated on the right portion of FIG. 2 another embodiment of the levelling members for constituting support members according to the invention. Here the bottom plate of the box 1 is formed integrally with outwardly extending cylindrical or prismatic recesses 19 for fittingly receiving protrusions of complementary shapes 20 extending outwardly from a face of a cylindrical or prismatic levelling member 111, the opposite face of each said levelling member 111 being formed with a recess having a shape corresponding to the shape of the recess 19 for receiving the protrusion of an adjacent levelling member, whereby permitting easy mounting and firm stacking thereof. As also illustrated on the right portion of FIG. 2, levelling members, such as those designated by the reference numerals 112 and 113, may be realized at least partially out of a magnetic material in the form of magnetic cylinders or discs which can be securably stacked for supporting an upper construction 114 having any determined shape and dimensions.

It can be easily understood that the arrangements illustrated in FIG. 2 allow to conveniently distribute all over the free upper surface of the box different releasable constructions 8, 110 or 114 which are immersed, close to the top surface of the product contained within the box, or emerged, by multiplying at will the mounting possibilities while keeping free the periphery of the top surface 10 adjacent the side-wall portions of the box and allowing for instance a child to manually propulse a small ship or any floating object all around the box without being hindered from doing so by constructions extending inwardly from the side-wall portion of the box that he could not pass round inwardly by reason of the width of the inclined portions 6 of the box. Such an arrangement further permits the nurse or mistress to store objects on such a releasable construction mounted at the middle of the box out of reach of the children.

There is illustrated in FIG. 4 a top view of the bottom 4 of the box 1 of the invention. Said bottom 4, which may be flat or slightly curved, is normally slightly inclined toward a draining opening or hole 21. The protruding or recessed mouldings 12, 19 in the bottom of the box adapted for releasable mounting of the levelling members yet stiffen in a certain extent the bottom of the box, said stiffening being however generally not sufficient for wide capacity boxes. A transverse or longitudinal ribbing of the bottom would result in retaining within the corresponding grooves a noticeable amount of the product contained within the box, whereby preventing a convenient draining thereof. According to the invention, the bottom 4 of the box has alternate series of ribs 22 and 22' protruding inwardly into the inner space of the box, the ribs extending alternatively over a portion of the bottom alternatively from the facing side-walls of the box defining said width. As best seen in FIGS. 2 and 4 said ribs 22 or 22' have in a cross section a shape of a substantially inverted "V" and a height which decreases from the side-wall from which they extend.

Although described and illustrated with reference to preferred embodiments, the present invention is not limited thereto and numerous alterations and additions may be made without departing from the spirit thereof. More particularly, the support members may be preassembled for a multipoint mounting on different recesses or raised mouldings in the bottom of the box, for instance for realizing a tripod assembly, and the lowermost levelling member such as that designated by reference numeral 11, may be permanently retained on the bottom of the box, for instance by snug fitting, to achieve easy stacking of only the upper levelling members when the box is filled, more particularly with water.

What I claim is:

1. A box construction for water, sand or the like product, comprising an integrally molded body having a bottom and side-walls prolongated outwardly by inwardly inclined edge portions, said body defining an inner space for containing a product, a separate construction member, a separate support member for supporting said construction member within said inner space for said body, said bottom of said body being locally provided with shaped mounting portions integrally formed therewith, said separate support member having releasable engaging means for releasable nesting engagement with a said shaped mounting portion so as to support at a distance inwardly from said edge portions of said body said releasable construction member at a selected height above said bottom wall of said body whereby said construction member is accessible when said box is filled with a product.

2. The construction of claim 1 wherein a plurality of said support members are provided, each said support member being stackable one above the other and at least one of said support members being provided with said releasable engaging means for engagement with a said mounting portion.

3. The construction of claim 2, wherein said support members are releasably mutually assembled.

4. The construction of claim 3, wherein said support members are frustoconical and hollow, at least one of said support members having its end of reduced diameter closed by a transverse bottom wall formed with at least a transversing hole.

5. The construction of claim 4, wherein said frustoconical hollow support members comprise at least a tranversing hole formed in the side-wall thereof.

6. The construction of claim 2, wherein said support members comprise means for being releasably assembled two by two.

7. The construction of claim 1, wherein said bottom wall comprises substantially parallel inwardly extending ribs, said ribs extending over a portion of the width of said bottom alternatively from the opposite side-walls of said box defining said width.

8. The construction of claim 7, wherein each said rib has a height which decreases from said side-wall from which it extends toward said opposite side-wall.

9. A box construction for water, sand or the like product comprising a bottom and side-walls prolongated upwardly and having inwardly inclined edge portions, said box defining an inner space for containing the product, said bottom of said box being locally provided with shaped mounting portions, separate support members each for cooperation in releasable engagement with a said shaped mounting portion, a releasable construction member mountable on a said support member whereby said releasable construction member is accessible even when said box is filled with said product, said support members each having means permitting stacking of said support members one upon another, said support members being releasably mutually assembled, and each being frustoconical and hollow in shape, at least one of said support members having its end of reduced diameter closed by a transverse bottom wall formed with at least a transversing hole, said frustoconical hollow support members comprising at least a transversing hole formed in the sidewall thereof, said support members being made out of plastic material, at least some of said support members having formed in the side-wall thereof longitudinal slots extending from the end of greater diameter to permit controllable radial deformation of said support members.

10. The construction of claim 1, wherein said releasable construction member is a plate member having means for releasable mounting on one end of said support members.

11. A box construction for water, sand or the like product, comprising a body integrally molded out of a plastic material and having a bottom and peripheral side-walls defining an inner space for containing the product, said bottom being formed with a drain hole, with two series of inwardly protruding ribs each extending from said side-walls in the direction of the opposite side-wall, the ribs of said series being interleaved and separated one from each other, two adjacent ribs extending from opposite side-walls, support members having shaped mounting portions, said bottom wall having shaped moldings for cooperation and engagement with the complementarily-shaped mounting portions of said support members so that said support members may be selectively releasably mounted on said bottom wall of said box, a construction member engageable with a said support member whereby said construction member will be supported adjacent the top surface of the product contained within the box and extending at a distance from said peripheral side walls of said box, a support element being formed by stacking at least two frustoconical hollow support members, said support members being made out of plastic material, said shaped mounting moldings in said bottom wall of said box having the form of frustoconical protrusions extending inwardly within said inner space defined by said body.

* * * * *